US005640645A

United States Patent [19]

Namekata et al.

[11] Patent Number: 5,640,645

[45] Date of Patent: Jun. 17, 1997

[54] IMAGE FORMING APPARATUS

[75] Inventors: Shinichi Namekata, Ebina; Katsuji Watabe, Fujimi; Yoshiyuki Kimura, Tokyo, all of Japan

[73] Assignee: Ricoh Company, Ltd., Tokyo, Japan

[21] Appl. No.: 358,100

[22] Filed: Dec. 16, 1994

[30] Foreign Application Priority Data

Dec. 16, 1993 [JP] Japan ..... 5-316752
Nov. 28, 1994 [JP] Japan ..... 6-293516

[51] Int. Cl.[6] ..... G03G 15/01; G03G 15/14

[52] U.S. Cl. ..... 399/66; 399/302

[58] Field of Search ..... 355/271, 274, 355/326 R, 327

[56] References Cited

U.S. PATENT DOCUMENTS

| | | | |
|---|---|---|---|
| 5,099,286 | 3/1992 | Nishise et al. | 355/326 R X |
| 5,182,598 | 1/1993 | Hara et al. | 355/271 X |
| 5,189,478 | 2/1993 | Hara et al. | 355/271 |
| 5,438,398 | 8/1995 | Tanigawa et al. | 355/271 |

FOREIGN PATENT DOCUMENTS

| | | |
|---|---|---|
| 3938354 | 5/1990 | Germany . |
| 3938647 | 5/1990 | Germany . |
| 4204470 | 8/1992 | Germany . |
| 58-205173 | 11/1983 | Japan . |
| 59-104673 | 6/1984 | Japan . |
| 63-23173 | 1/1988 | Japan . |
| 1-166070 | 6/1989 | Japan . |
| 3-107977 | 5/1991 | Japan . |
| 4-5670 | 1/1992 | Japan . |
| 5-150625 | 6/1993 | Japan . |
| 5-333701 | 12/1993 | Japan . |

OTHER PUBLICATIONS

Patent Abstracts of Japan, vol. 17, No. 273, May 26, 1993 JP-A-5-11562, Jan. 22. 1993.

*Primary Examiner*—Fred L. Braun
*Attorney, Agent, or Firm*—Oblon, Spivak, McClelland, Maier & Neustadt, P.C.

[57] ABSTRACT

In an image forming apparatus, toner images of respective colors are sequentially formed on an image carrier. A primary image transfer unit sequentially transfers the toner images from the image carrier to an intermediate image transfer belt one above the other, thereby producing a composite color image on the belt. A secondary image transfer unit transfers the composite color image from the belt to a sheet or similar transfer material. When the belt makes a turn without image transfer, i.e., idles, an electric field output lower than an electric field output preselected for image formation is applied to the primary image transfer unit.

15 Claims, 14 Drawing Sheets

IMAGE FORMING APPARATUS

BACKGROUND OF THE INVENTION

The present invention relates to a copier, laser printer or similar image forming apparatus and, more particularly, to an image forming apparatus of the type having an intermediate image transfer member for transferring a black image and color images to a single sheet or similar transfer material one above the other.

A color image forming apparatus having an intermediate image transfer member implemented as, for example, a belt is disclosed in Japanese Patent Laid-Open Publication No. 5-11562 by way of example. In this type of apparatus, color toner images are sequentially formed on an image carrier and sequentially transferred to the belt one above the other, thereby forming a composite toner image on the belt. The composite toner image is transferred from the belt to a sheet or similar transfer material. The image transfer from the image carrier to the belt and the image transfer from the belt to the transfer material will be referred to as primary or belt transfer and secondary or sheet transfer, respectively. This kind of system has an excellent paper-free feature since the sheet does not wrap around the belt, compared to a system using a transfer drum. However, the belt must have a circumferential length guaranteeing at least the maximum print size. Moreover, the actual length of the belt is further increased in consideration of, for example, a period of time necessary for the return of a scanner. Such a belt increases the overall size and, therefore, the cost of the apparatus. In addition, for copies of small sizes, the period of time for one turn of the belt is excessively long, so that an additional copying time is needed even when only a single copy is desired.

In light of the above, there has been proposed a system which, by reducing the circumferential length of the belt, ensures a desired copying speed even with copies of small sizes and, in addition, prevents the allowable maximum print size from being reduced. Specifically, to produce a copy of large size approximate to the circumferential length of the belt, the system causes the belt to rotate without image transfer, i.e., to "idle" between the primary transfer of one color and that of another color, thereby guaranteeing, for example, an interval for the scanner to return.

However the system causing the belt to idle as mentioned above has some issues yet to be solved, as follows. Although no images are formed on the image carrier while the belt idles, the image carrier and belt are constantly held in contact. Hence, assuming a copy of large size, if an electric field for the primary image transfer is turned off, it is likely that a toner image is reversely transferred from the belt to the image carrier. Particularly, with an intermediate transfer belt having a medium resistance, the reserve transfer occurs easily even if the above-mentioned electric field is turned off. Specifically, potentials deposited on such a belt and the image carrier are about 0 V and about −700 V, respectively. Hence, although the toner on the belt is attracted due to the orientation of an electric field, such a degree of attraction cannot overcome the other forces including a mechanical force. If the electric field for image transfer is the same as the electric field for image formation, toner contaminating the background of the image carrier is transferred to the belt when the belt idles. Generally, since the background contamination of the image carrier cannot be fully avoided at the time of development, it is allowed within a certain range. However, if the transfer of the toner contaminating the background from the image carrier to the belt is allowed even during idling, the contamination is doubled, compared to copying using a sheet of small size and not involving idling.

Further, the idling scheme has a problem relating to the secondary transfer, i.e., the transfer from the belt to the sheet or similar transfer material. Usually, the belt has a medium resistance, i.e., a volume resistivity ranging from $1\times10^8$ Ω.cm to $10^{12}$ Ω.cm (measured by JIS K6911). This kind of belt causes a potential deposited by primary transfer means to attenuate and then disappear due to the time constant thereof. Hence, it is possible to eliminate the need for AC corona discharger or similar means for discharging the belt, to obviate ozone particular to such discharging means, to reduce the cost, and to prevent the apparatus from increasing in size. Should the belt be made of an insulating material, means for discharging it would be necessary and would increase the size and cost of the apparatus, complicate control, and generate ozone.

SUMMARY OF THE INVENTION

It is, therefore, an object of the present invention to provide an image forming apparatus which eliminates the transfer of background contamination and reverse transfer even when an intermediate image transfer member idles during copying using a sheet of large size, thereby ensuring high quality images.

In accordance with the present invention, an image forming apparatus has an image carrier for sequentially forming toner images of respective colors thereon, an intermediate image transfer member to which the toner images are sequentially transferred one above the other, a primary image transfer unit for sequentially transferring the toner images from the image carrier to the intermediate image transfer member one above the other by charging, thereby forming a composite toner image, and a secondary image transfer unit for transferring the composite toner image from the intermediate image transfer member to a transfer material. When the image area of the intermediate image transfer member to which at least one color has been transferred passes through, without image transfer, a primary transfer position where it faces the image carrier, an electric field output applied to the primary image transfer unit is controlled to be lower than an electric field output preselected for image formation.

Also, in accordance with the present invention, an image forming apparatus has an image carrier for sequentially forming toner images of respective colors thereon, an intermediate image transfer member to which the toner images are sequentially transferred one above the other, a primary image transfer unit for sequentially transferring the toner images from the image carrier to the intermediate image transfer member by charging, thereby forming a composite toner image, and a secondary image transfer unit for transferring the composite toner image from the intermediate image transfer member to a transfer material. An electric field output applied to the primary image transfer unit when the image area of the intermediate image transfer member to which at least one color has been transferred passes through, without image transfer, a primary transfer position where the intermediate image transfer member faces the image carrier is controlled such that toner carried on the intermediate image transfer member has a predetermined amount of charge, as measured at a secondary transfer position where the intermediate image transfer member faces the transfer material.

Further, in accordance with the present invention, an image forming apparatus has an image carrier for sequentially forming toner images of respective colors thereon, an intermediate image transfer member to which the toner images are sequentially transferred one above the other, a primary image transfer unit for sequentially transferring the toner images from the image carrier to the intermediate image transfer member by charging, thereby forming a composite toner image, and a secondary image transfer unit for transferring the composite toner image from the intermediate image transfer member to a transfer material. An electric field output applied to the primary image transfer unit when the image area of the intermediate image transfer member to which at least one color has been transferred passes through, without image transfer, a primary transfer position where the intermediate image transfer member faces the image carrier is lower than an electric field output preselected for image formation and lower than an electric field output applied to the second image transfer means in the event of secondary image transfer to the transfer material.

Further, in accordance with the present invention, an image forming apparatus has an image carrier for sequentially forming toner images of respective colors thereon, an intermediate image transfer member to which the toner images are sequentially transferred one above the other, a primary image transfer unit for sequentially transferring the toner images from the image carrier to said intermediate image transfer member by charging, thereby forming a composite toner image, and a secondary image transfer unit for transferring the composite toner image from the intermediate image transfer member to a transfer material. An electric field output applied to the primary image transfer unit when the image area of the intermediate image transfer member to which at least one color has been transferred passes through, without image transfer, a primary intermediate image transfer position where the transfer member faces the image carrier is dependent on an electric field output applied to the secondary image transfer unit when the image area passes through, without image transfer, a secondary transfer position where the intermediate image transfer member faces the transfer material.

Further, in accordance with the present invention, an image forming apparatus has an image carrier on which toner images of respective colors are sequentially formed by a developing device which is applied with a bias for development, an intermediate image transfer member to which the toner images are sequentially transferred one above the other, a primary image transfer unit for sequentially transferring the toner images from the image carrier to the intermediate image transfer member by charging, thereby forming a composite toner image, and a secondary image transfer unit for transferring the composite toner image from the intermediate image transfer member to a transfer material. When the image area of the intermediate image transfer member to which at least one color has been transferred passes through, without image transfer, a primary transfer position where the intermediate image transfer member faces the image carrier, a difference between the surface potential of the area of the image carrier facing the image area and the bias for development is greater than a difference preselected for image formation.

Furthermore, in accordance with the present invention, an image forming apparatus has an image carrier on which toner images of respective colors are sequentially formed by toner of the respective colors which are fed from respective developing rollers, an intermediate image transfer member to which the toner images are sequentially transferred one above the other, a primary image transfer unit for sequentially transferring the toner images from the image carrier to the intermediate image transfer member by charging, thereby forming a composite toner image, and a secondary image transfer unit for transferring the composite toner image from the intermediate image transfer member to a transfer material. When the image area of the intermediate image transfer member to which at least one color has been transferred passes through, without image transfer, a primary transfer position where the intermediate image transfer member faces the image carrier, the area of said image carrier facing the image area is held in a nondeveloping condition with no toner being fed from the developing roller to the image carrier.

Moreover, in accordance with the present invention, an image forming apparatus has an image carrier on which toner images of respective colors are sequentially formed by toner of the respective colors which are fed from respective developing rollers, an intermediate image transfer member to which the toner images are sequentially transferred one above the other, a primary image transfer unit for sequentially transferring the toner images from the image carrier to the intermediate image transfer member by charging, thereby forming a composite toner image, and a secondary image transfer unit for transferring the composite toner image from the intermediate image transfer member to a transfer material. The area of the image carrier to face the image area of the intermediate image transfer member, to which at least one color has been transferred, when the image area passes through, without image transfer, a primary transfer position where the intermediate image transfer member faces the image carrier is formed by making a ratio of the linear velocity of any one of the developing rollers to the linear velocity of the image carrier higher than a ratio preselected for image formation.

In addition, in accordance with the present invention, an image forming apparatus has an image carrier on which toner images of respective colors are sequentially formed by toner of the respective colors each being stored in one of developing units of a revolver type developing device, an intermediate image transfer member to which the toner images are sequentially transferred one above the other, a primary image transfer unit for sequentially transferring the toner images from the image carrier to the intermediate image transfer member by charging, thereby forming a composite toner image, and a secondary image transfer unit for transferring the composite toner image from the intermediate image transfer member to a transfer material. When the image area of the intermediate image transfer member to which at least one color has been transferred passes through, without image transfer, a primary transfer position where the intermediate image transfer member faces the image carrier, none of the developing units faces the image carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
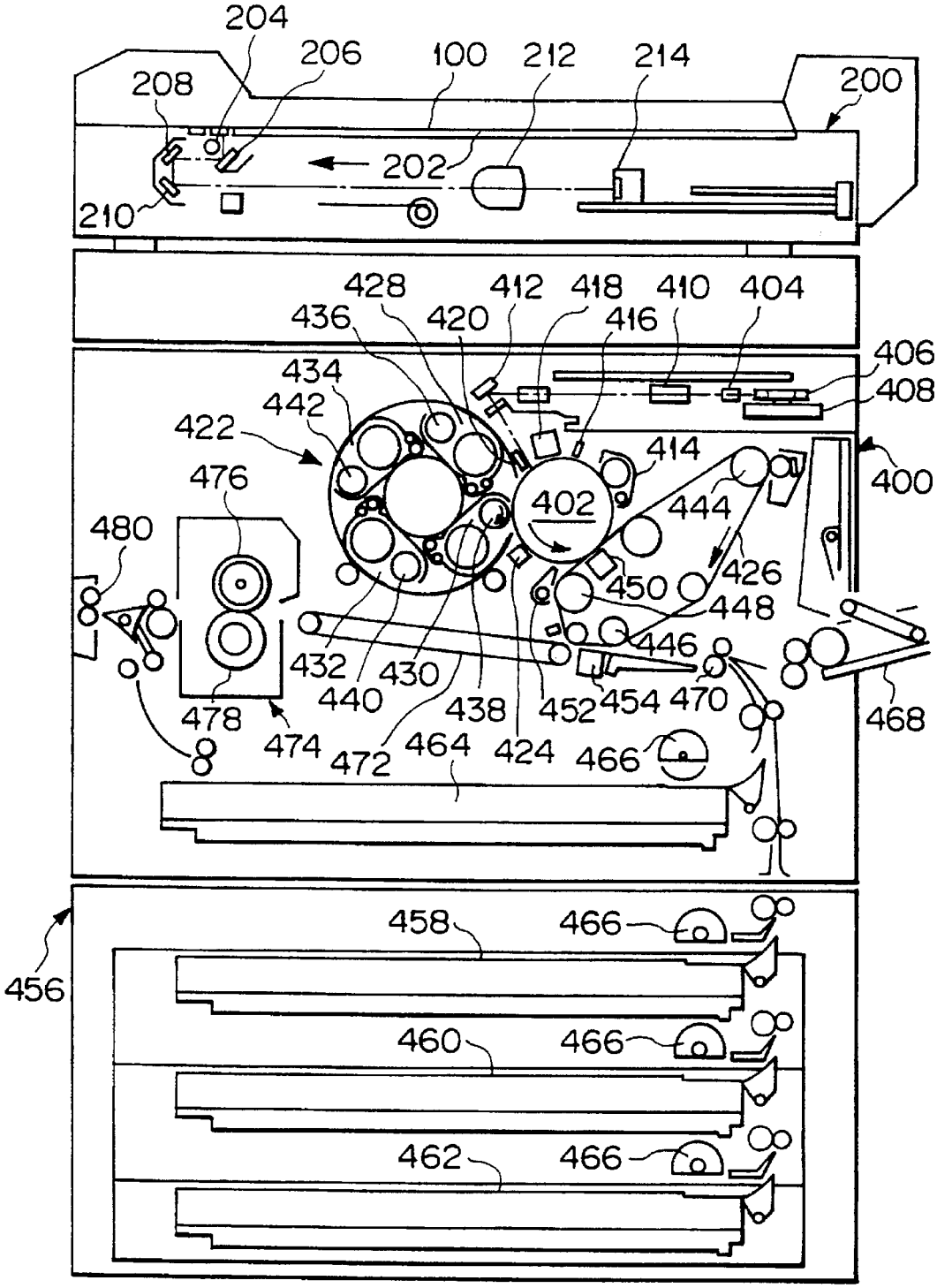
FIG. 1 is a section of a conventional color image forming apparatus to which the present invention is applicable.

Referring to FIG. 1 of the drawings, a conventional color image forming apparatus to which the present invention is applicable is shown. As shown, the apparatus is generally made up of a color scanner or color image reading device 200, a color printer or color image recording device 400, and a sheet bank 456. A color document 100 is laid on a glass platen 202 and illuminated by a lamp 204 included in the scanner 200. The resulting reflection from the document 100 is routed through mirrors 206, 208 and 210 and a lens 212 to a color image sensor 214. The image sensor 214 reads the separated color components of the reflection, e.g., a blue, green and red component, thereby producing corresponding electric signals. Specifically, the image sensor 214 has blue, green and red color separating means and photoelectric transducers (charge coupled devices or CCDs) and reads the three color components at the same time. An image processor, not shown, transforms the blue, green and red image signals to black, cyan, magenta and yellow color image data on the basis of the intensity levels of the input image signals. The color printer 400 prints out the black, cyan, magenta and yellow data on a sheet to produce a color copy. To produce the black, cyan, magenta and yellow image data, the lamp and mirrors of the scanner 200 are moved to the left, as indicated by an arrow in the figure, in response to a scanner start signal synchronous to the operation of the printer 400. Every time the scanner 200 scans the document, image data of one color are produced. This is repeated four consecutive times to sequentially produce image data of four colors. The printer 400 sequentially converts the image data of four colors to toner images while superposing, them, thereby producing a four-color or full-color image.

The color printer 400 will be outlined hereinafter. An optical writing unit transforms the color image data from the scanner 200 to an optical signal and writes the document image on a photoconductive element, or image carrier, 402 with the optical signal, thereby electrostatically forming a latent image on the element 402. The photoconductive element 402 is implemented as a drum by way of example. The writing unit has laser beam emitting means (laser diode or LD) 404, an LD drive controller, not shown, a polygon mirror 406, a motor 408 for rotating the mirror 406, an f-theta lens 410, a mirror 412, etc. The drum 402 is rotatable counterclockwise, as indicated by an arrow in the figure. Arranged around the drum 402 are a drum cleaning unit 414, a discharge lamp 416, a main charger 418, a potential sensor 420, a revolver type developing device 422, a density pattern sensor 424, an intermediate image transfer member in the form of a belt 426, etc.

The developing device or revolver 422 is made up of a black developing unit 428, a cyan developing unit 430, a magenta developing unit 432, a yellow developing unit 434, and a drive section, not shown, for rotating the revolver 422. The developing units 428–434 respectively include developing sleeves (436, 438, 440 and 442) and paddles. The developing sleeves are each rotated with a developer deposited, thereon contacting the surface of the drum 402. Each paddle scoops up and agitate a developer. While the apparatus is not in operation, the revolver 422 is positioned such that the black developing unit 428 is ready to effect development. On the start of a copying operation, the scanner 200 starts reading a document and producing black image data at a predetermined time. Then, optical writing and image formation begin on the basis of the image data. Let latent images derived from black, cyan, magenta and yellow image data be respectively referred to as a black latent image, a cyan latent image, a magenta latent image and a yellow latent image for a distinction purpose. To develop the black latent image from the leading edge thereof, the developing sleeve 436 starts rotating before the leading edge arrives at the developing position where the developing unit 428 is positioned. As a result, the black latent image is developed by a black toner deposited on the sleeve 436. As soon as the trailing edge of the black latent image moves away from the developing position, the revolver 422 is rotated until the next developing unit reaches the developing position. This is completed at least before the leading edge of the next latent image arrives at the developing position.

When an image forming cycle begins, the drum 402 is rotated counterclockwise while the belt 426 is rotated clockwise, as indicated by arrows in FIG. 1. As a result, a black toner image, a cyan toner image, a magenta toner image and a yellow toner image are sequentially formed in this order and transferred to the belt 426 one above the other.

First, a black image is formed by the following procedure. The main charger 418 uniformly charges the surface of the drum 402 to about −700 V by corona discharge. The LD 404 scans, in response to a black signal, the charged surface of the drum 402 with a laser beam by raster scanning. As a result, the part of the drum 402 scanned by the LD 404 loses the charge in proportion to the quantity of light, thereby forming a potential distribution or electrostatic latent image. Toner stored in the revolver 422 is charged to a negative polarity by being agitated together with a ferrite carrier. The black developing sleeve 436 is biased by power source means, not shown, to a potential implemented by a negative DC potential and AC superposed on each other relative to the metallic base layer of the drum 402. Consequently, toner does not deposit on the portions of the drum 402 where the charge is present, but it deposits on the portions where the charge is absent, i.e., exposed portions. As a result, the black latent image turns out a black toner image on the drum 402.

The belt 426 is passed over a drive roller 444, a roller 446 facing an image transfer position, a roller 448 facing a cleaning position, and driven rollers. The drive roller 444 is rotated by a motor, not shown. The belt 426 is drive at a constant speed in contact with the drum 402. A belt transfer corona discharger, or belt transfer unit as referred to hereinafter, 450 transfers the black toner image from the drum 402 to the belt 426. Let the image transfer from the drum 402 to the belt 426 be referred to as belt transfer. The discharge efficiency of the belt transfer unit 450 is about 20 to 40%. After the belt transfer, the drum cleaning unit 414 removes the toner remaining on the drum 402 so as to prepare it for the next image forming cycle. The toner removed by the cleaning unit 414 is collected in a waste toner tank, not shown, via a piping.

The black, cyan, magenta and yellow toner images sequentially formed on the drum 402 are transferred to the belt 426 one above the other in accurate register. The resulting composite image is transferred from the belt 426 to a sheet or similar transfer material by a sheet transfer corona discharger 454, which will be described, at a time. As for the drum 402, a cyan toner image is formed after the black toner image. Specifically, the scanner 200 starts reading a cyan image component at a predetermined time, so that a cyan latent image is formed on the drum 402 by laser beam writing.

After the trailing edge of the black toner image has moved away from the developing position, but before the leading edge of a cyan latent image arrives there, the revolver 422 is rotated to cause the cyan developing unit 430 to develop the cyan latent image with cyan toner. After the trailing edge of the cyan latent image has moved away from the developing position, the revolver 422 is again rotated. This is completed before the leading edge of the next or magenta latent image arrives at the developing position. The image forming steps associated with magenta and yellow will not be described since they are identical with the steps described above in relation to black and cyan.

A belt cleaning device 452 has an inlet seal, rubber blade, discharge coil, seal and blade moving mechanism, etc., although not shown specifically. While the second, third and fourth belt transfer steps, following the first or black belt transfer step are under way, the above-mentioned mechanism maintains the inlet seal and blade spaced apart from the belt 426. The sheet transfer corona discharger, or sheet transfer unit as referred to hereinafter, 454 is applied with DC or AC-biased DC to transfer the composite toner image from the belt 426 to a sheet by corona discharge. The sheet transfer unit 454 has the same discharge efficiency as the belt transfer unit 450.

The sheet bank 456 has sheet cassettes 458, 460 and 462 each storing sheets of particular size different from the size of sheets stored in a sheet cassette 464 which is disposed in the apparatus body. Sheets of designated size are sequentially fed from one of the cassettes 458–462 by a pick-up roller 466 toward a registration roller pair 470. The reference numeral 468 designates a manual feed tray available for OHP (Over Head Projector) sheets, thick sheets, etc. The sheet is once brought to a stop by the registration roller pair 470. When the leading edge of a toner image carried on the belt 426 is about to reach the sheet transfer unit 454, the registration roller pair 470 is driven such that the leading edge of the sheet meets that of the toner image. The sheet, superposed on the toner image on the belt 426, moves over the sheet transfer unit 454 to which a positive potential is applied. At this instant, the sheet transfer unit 454 charges the sheet to positive polarity by corona discharge, thereby transferring the substantial portion of the toner image to the sheet. A discharge brush, not shown, is located at the left of the sheet transfer unit 454, as viewed in the figure. When the sheet passes by the discharge brush, it is discharged. As a result, the sheet is separated from the belt 426 and transferred to a conveyor belt 472. On reaching a fixing unit 474, the sheet has the toner image fixed thereon. Specifically, the fixing unit 474 has a heat roller 476 controlled to a predetermined temperature and a press roller 478. As the sheet passes through the nip portion of the rollers 476 and 478, the toner image is fixed on the sheet by heat. Thereafter, the sheet is driven out of the apparatus body by a discharge roller pair 480. As a result, the sheet or full-color copy is laid on a copy tray, not shown, face up.

After the transfer of the toner image from the drum 402 to the belt 426, the drum 402 has the surface thereof cleaned by the drum cleaning unit 414 which includes a brush roller or a rubber blade. Subsequently, the discharge lamp 416 uniformly dissipates the charges remaining on the drum 402. Likewise, after the transfer of the composite toner image from the belt 426 to the sheet, the moving mechanism included in the belt cleaning device 452 again urges the blade against the belt 426 so as to clean it.

In a repeat copy mode, the formation of the fourth color image for the first sheet is followed by the formation of the first color image for the second sheet. As for the belt 426, a black toner image for the second sheet is transferred from the drum 402 to the part of the belt surface cleaned by the cleaning device 452. This is followed by the above-described procedure.

The above description has concentrated on a copy mode wherein a sheet of A4 size is fed in a transversely long position to produce a four-color copy. In a three-color or two-color copy mode, the procedure described above is repeated a number of times corresponding to the number of colors and the number of copies. Further, in a single color copy mode, only one of the developing units of the revolver 422 which stores toner of desired color is held at the developing position until a desired number of copies have been produced; the belt cleaning device 452 holds the blade thereof in contact with the belt 426.

How the apparatus produces a full-color copy with a sheet of A3 size, which is the maximum size available with the apparatus, will be described. As for this size of color copy, it will be efficient to form an image of one color every time the belt 426 makes one turn and to complete a four-color image when it reaches the end of the fourth turn. However, when the circumferential length of the belt 426 is reduced as far as possible in conformity to the maximum sheet size, there arises a problem that during a copying operation dealing with the maximum sheet size, a period of time for the scanner 200 to return is not available. On the other hand, when the belt 426 is dimensioned in matching relation to A3 size or similar maximum size which is rarely used, much time is simply wasted when use is made of sheets of A4 size and B5 size which are smaller than the maximum size and frequently used. In light of this, the apparatus is constructed such that for a sheet of A3 size, a single image is formed while the belt 426 makes two turns. Specifically, after the belt transfer of a black toner image, the belt 426 simply makes one turn without development or image transfer, and then development and belt transfer are effected during the next turn of the belt 426. In this manner, when use is made of a sheet of large size approximate to the circumferential length of the belt 426, the scanner 200 is returned while the belt 426 simply "idles" between consecutive belt transfer. This successfully ensure a desired copying speed even with sheets of small sizes by reducing the circumferential length of the belt 426 and, in addition, prevents the maximum allowable size from being reduced.

Figure 3A:
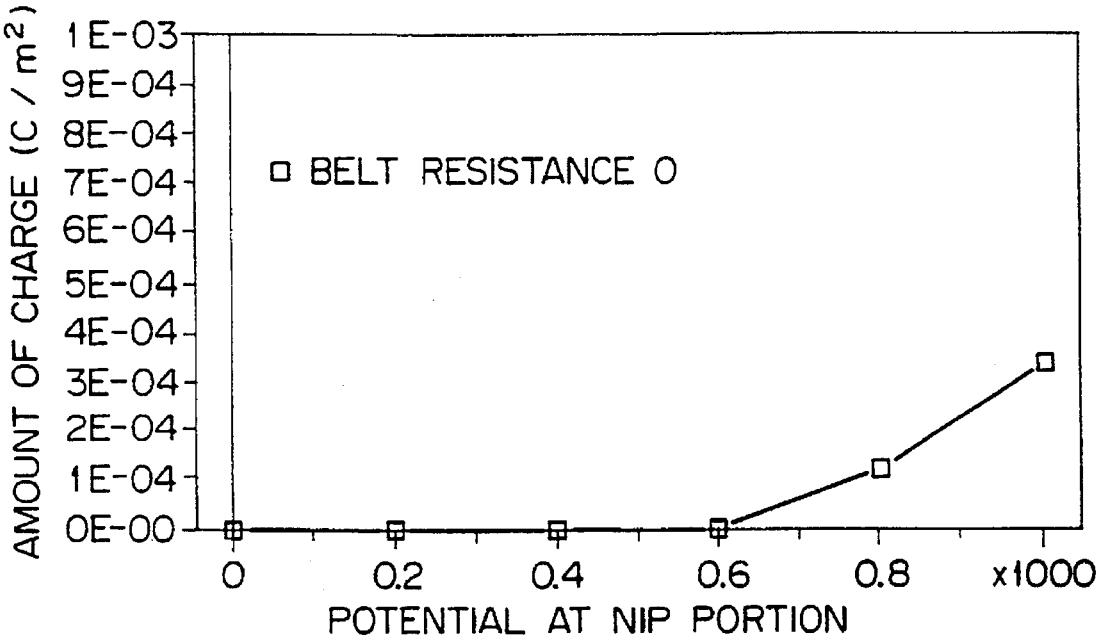
FIGS. 3A and 3B are graphs each showing a particular result of discharge measured at the outlet of a photoconductive element and an intermediate image transfer belt included in a system using a primary transfer roller.
Figure 3B:
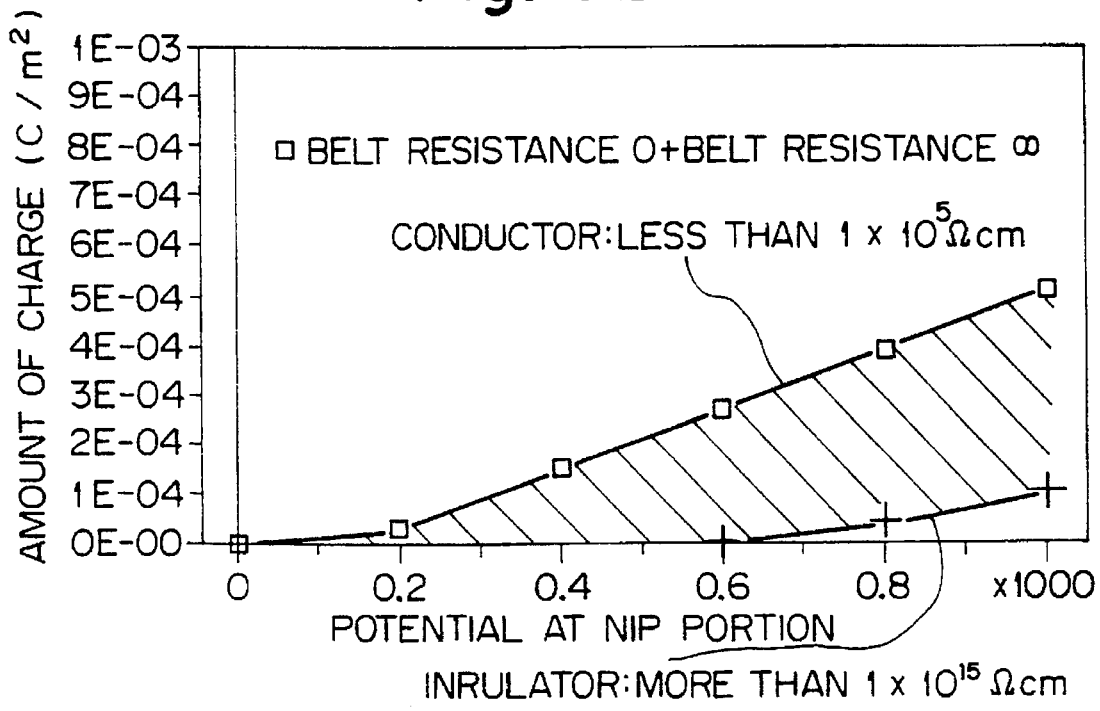

FIGS. 3A and 3B respectively show the results of discharge observed during image formation and during "idling" at the outlet side of a photoconductive drum and an intermediate transfer belt which are included an intermediate image transfer system using a bias roller as primary image transferring means. In the figures, the abscissa indicates a potential at a nip portion where the drum and belt contact each other. When the potential at the nip portion is 300 V(actually measured value), no discharge occurs if resistance is infinite while discharge occurs in an amount of $10^{-4}$ $c/m^2$ if resistance is zero. Even when the transferring means is implemented as a corona charger, the amount of charge (Q/M) deposited on toner, as measured on the belt having a medium resistance, shows substantially the same transition as when it is implemented as the roller. FIGS. 3A and 3B suggest that discharge occurs at the outlet side where the belt and drum move away from each other, urging the charge from the drum toward the belt. In this manner, the amount of charge due to discharge has effect on a certain belt resistance; discharge occurs and increases Q/M easily when resistance is low (conductor), but it does not do so when resistance is high (insulator). The belt having a medium resistance is regarded to lie between such resistances and increases Q/M more easily than a belt made of an insulator.

Figure 2:
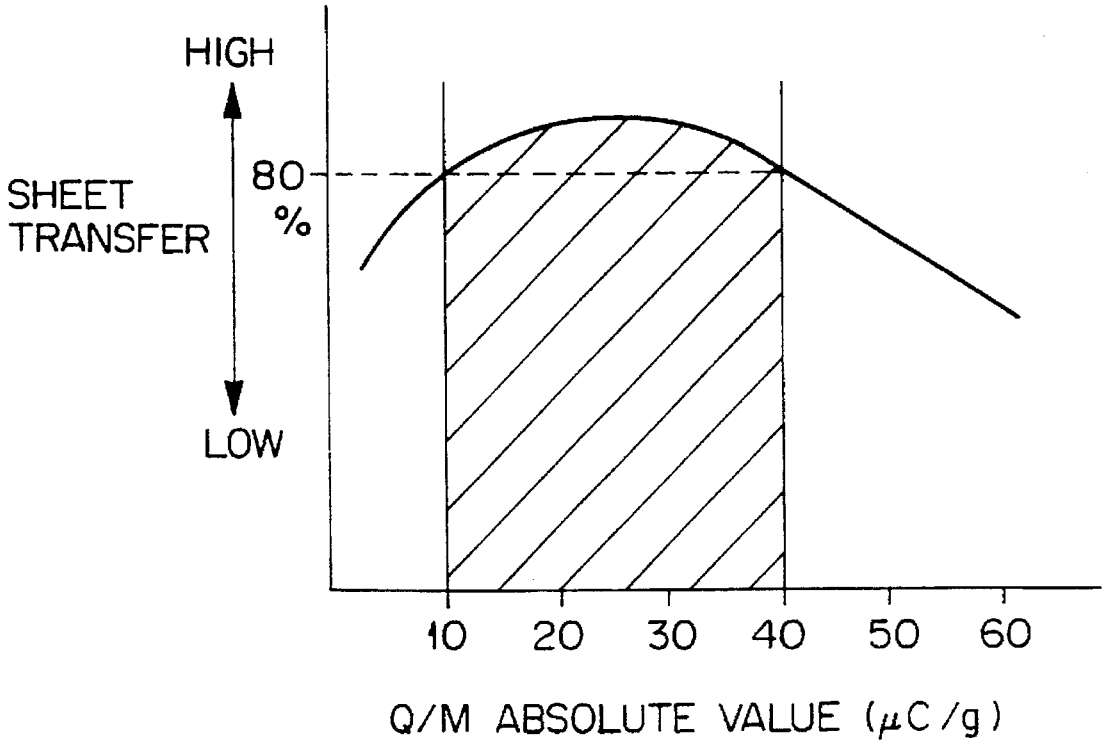
FIG. 2 is a graph indicating a relation between the image transfer to a sheet and the amount of charge to deposit on toner.

However, to transfer toner from the belt to a sheet or similar transfer medium in a desirable manner (so-called secondary transfer; transfer ratio of more than 80%), the amount of charge of toner on the belt must lie in a predetermined range, as shown in FIG. 2. While Q/M on the belt depends on Q/M in a developer, it is also noticeably affected by the subsequent primary transfer. Specifically, experiments showed that Q/M of the color already transferred from the drum to the belt sequentially increases every time another color is superposed thereon. Hence, during the image formation including "idling", Q/M before the secondary transfer increases to an excessive degree, compared to image formation dealing with sheets of small sizes. However, when the primary transfer current is turned off while the belt idles, toner is reversely transferred from the belt to the drum, as discussed previously.

A color image forming apparatus embodying the present invention will be described which eliminates the problem stated above. Since the embodiment is basically similar to the conventional apparatus of FIG. 1 as to the general construction and arrangement, the following description will concentrate on essential parts to which the present invention pertains. It is to be noted that the revolver 422 shown in FIG. 1 may, of course, be replaced with a developing device of the type having independent developing units arranged around a photoconductive drum.

Figure 4:
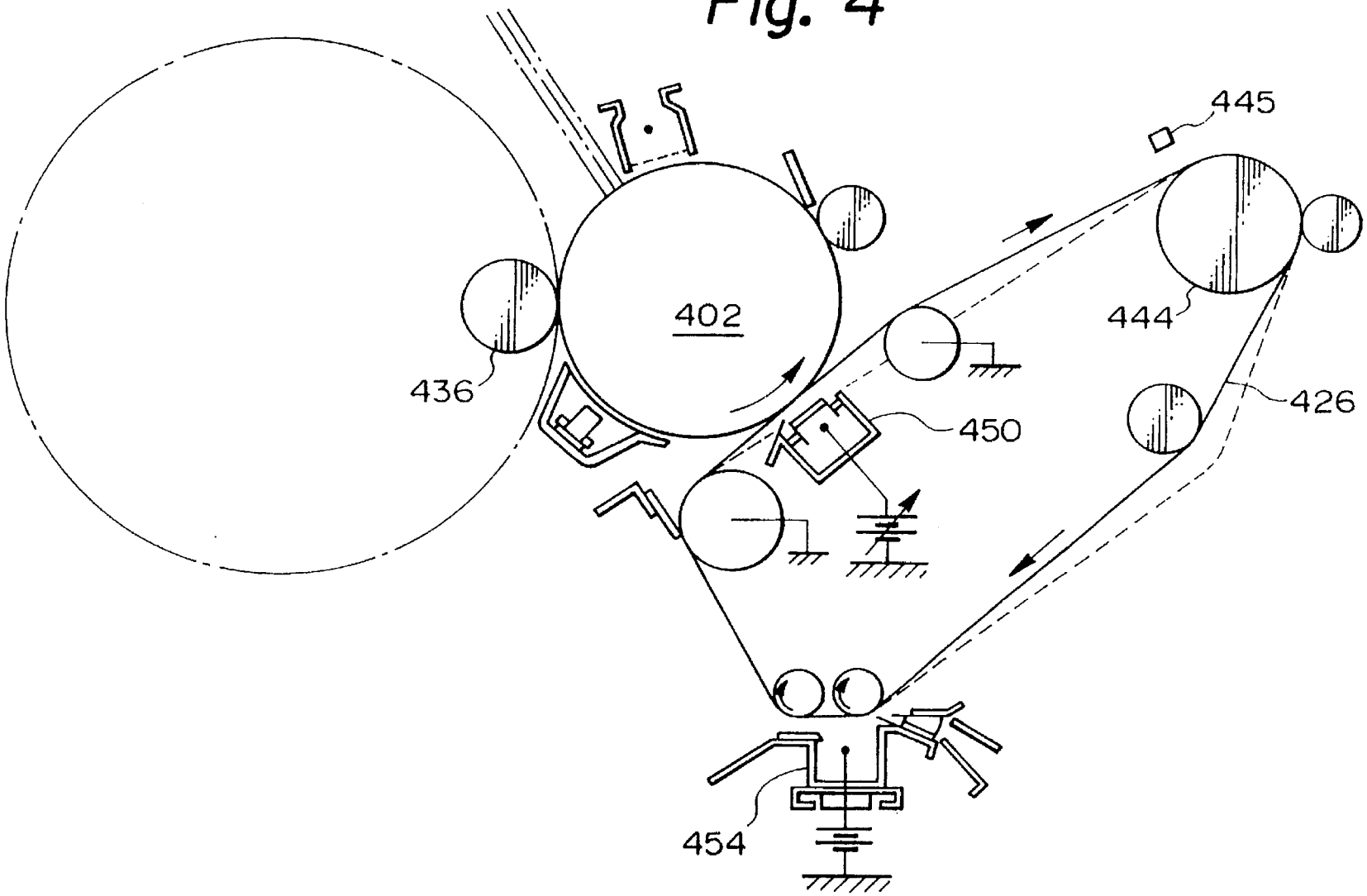
FIG. 4 is a view demonstrating image transfer using a corona charger type image transfer unit.

In the embodiment, the belt 426 has a medium resistance, i.e., a volume resistivity of $1\times10^{8}$ Ω.cm to $1\times10^{12}$ Ω.cm and a surface resistivity of $1\times10^{8}$ Ω to $1\times10^{11}$ Ω (JIS K6911). The belt 426 may, of course, be replaced with a drum. Substances having such a medium resistance include ethylene tetrafluoroethylene (ETFE) and epichlorihydrin rubber. A reference will be made to FIGS. 4 and 5 for describing image transfer to occur when the belt 426 having a medium resistance is used to form a full-color image of maximum size; black, cyan, magenta and yellow images are formed in this order. To bring the respective images into accurate register, it is necessary to position each image on the belt 426 accurately. For this purpose, the embodiment provides the belt 426 with a reference mark.

Assume that a full-color copy mode and sheets of A3 size are selected on an operation panel, not shown. In response to a copy start command, a motor, not shown, drives the drum 402, belt 426, etc. A reference mark is provided on the belt 426 outside of an image forming zone, e.g., in a front edge portion as viewed in a direction perpendicular to the sheet surface of FIG. 4. A photosensor 445 is located in the vicinity of the belt 426 and drive roller 444 and senses the reference mark of the belt 426. When a predetermined period of time elapses since the photosensor 445 has sensed the reference mark, a document read start signal and a data write start signal are sequentially generated to read a document and write the resulting image data on the drum 402. A black (BK) latent image is developed by the developing sleeve 436 of the black developing unit. The resulting black toner image on the drum 402 is moved to a primary transfer position where the drum 402 and belt 426 contact each other. A corona charger type belt transfer unit 450 is controlled by a constant current and connected to a power source whose target control current is variable. When a primary transfer current of 50 μA is output to the belt 426 from the transfer unit 450, the black toner image is transferred to the belt 426.

When the photosensor 445 senses the reference mark again, no images are formed on the drum 402 while the belt 426 simply idles. Hence, the black toner on the belt 426 passes through the primary transfer position. At this instant, a primary transfer current of 30 μA is output from the belt transfer unit 450. When the photosensor 445 senses the reference mark the third time, an image is written to the drum at the same timing as during the first turn of the belt 426. Specifically, a cyan (C) toner image is formed on the drum 402 such that it will be brought into register with the black toner image on the belt 426. The cyan toner image is transferred to the belt 426 by the belt transfer unit 450 which applies a primary transfer current of 100 μA this time. When the photosensor 445 senses the reference mark the fourth time, the belt 426 again idles while the belt transfer unit 450 outputs a primary transfer current of 30 μm. In the same manner, the belt transfer unit 450 outputs a current of 100 μm for a magenta (M) toner image during the fifth turn of the belt 426, a current of 30 μA for idling during the sixth turn, and a current of 100 82 A for a yellow (Y) toner image during the seven turn. After all the four toner images have been transferred to the belt 426 one above the other, a sheet is fed such that it reaches a secondary transfer position, i.e., the belt 426 and sheet transfer unit 454 at a predetermined timing. The sheet transfer unit transfers the composite color image from the belt 426 to the sheet with a secondary transfer current of 20 μA.

Figure 5A:
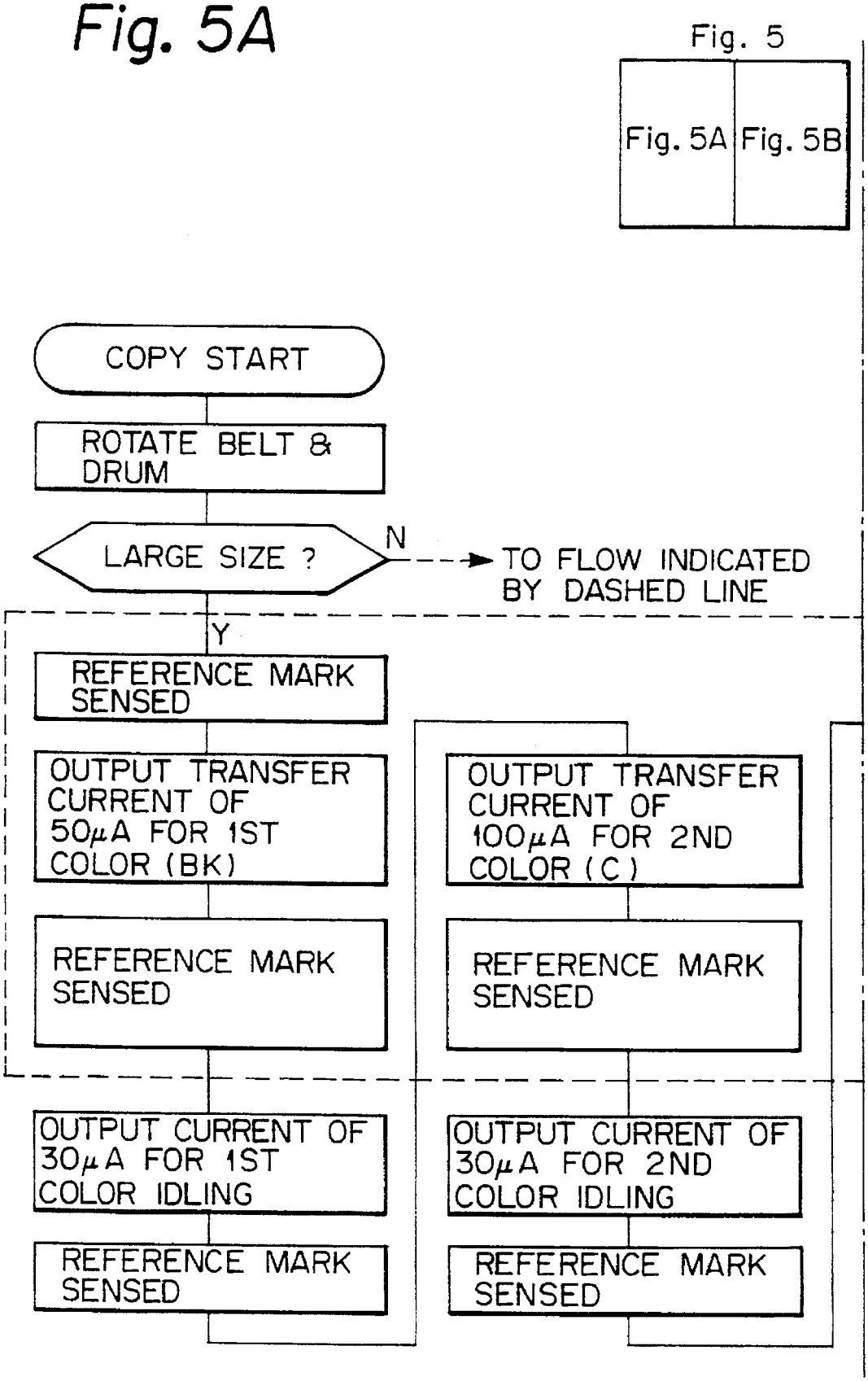
FIG. 5 is a flowchart representing a specific procedure for transferring different colors one above the other by maintaining a primary transfer current constant.
Figure 5B:
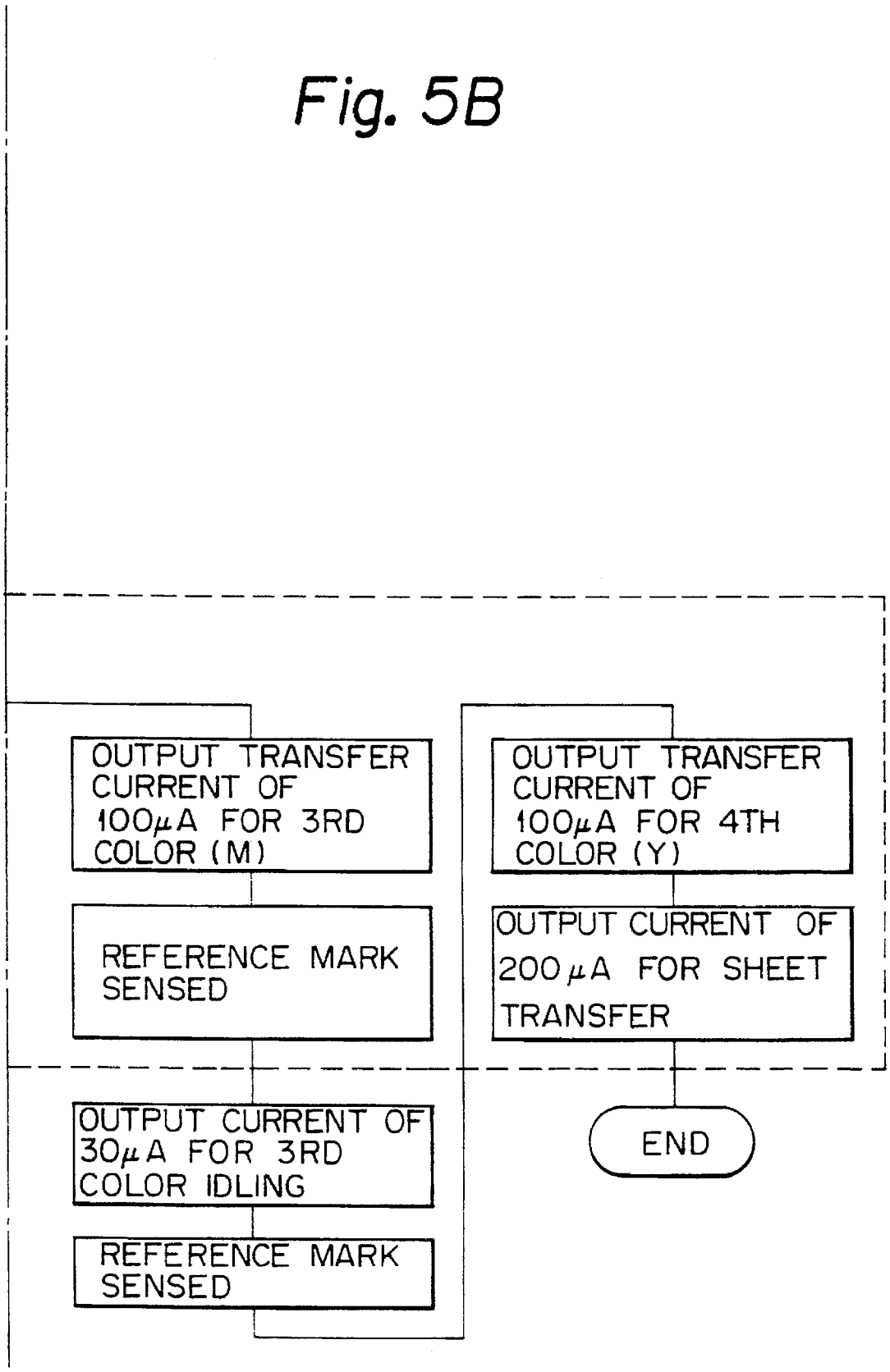

In the illustrative embodiment, the primary transfer current assigned to idling is output during the second, fourth and sixth turns of the belt 426. If desired, such a primary transfer current may be output even during the first, third, fifth and seventh turns only for the area other than the image area. For example, assuming an image area of A3 size, the remaining area from the trailing edge of the image is the above-mentioned area other than the image area. This kind of scheme will reduce the contamination of the background of the belt 426 not only during idling but also during rotation for the primary transfer. Regarding A4 or similar small size, the primary transfer current and secondary transfer are controlled color by color in the same manner as shown in FIG. 5 although idling does not occur.

Figure 6:
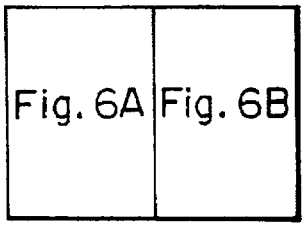
FIG. 6 is a flowchart representing a specific procedure for superposing different colors by increasing the primary transfer current stepwise.
Figure 6A:
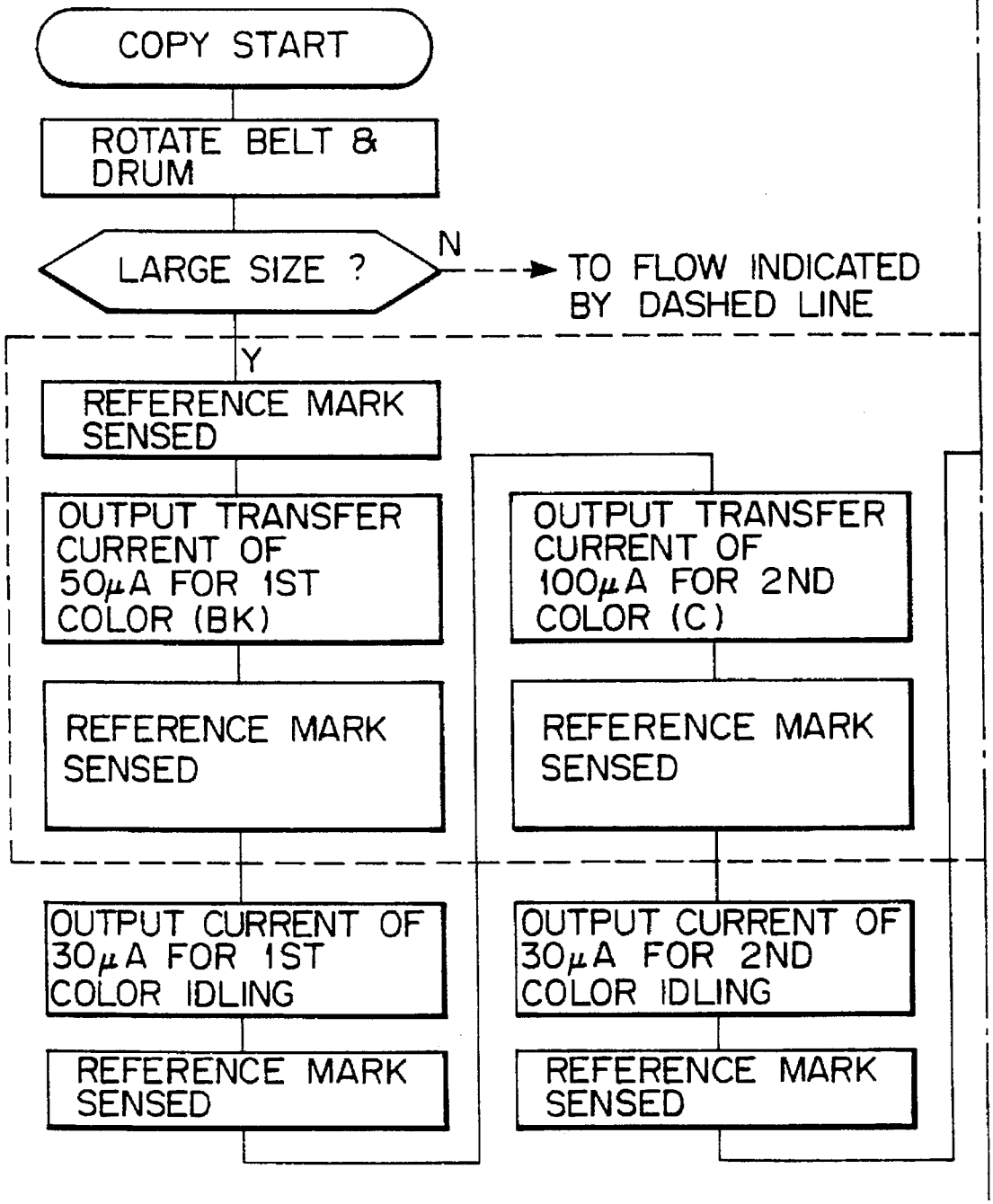
Figure 6B:
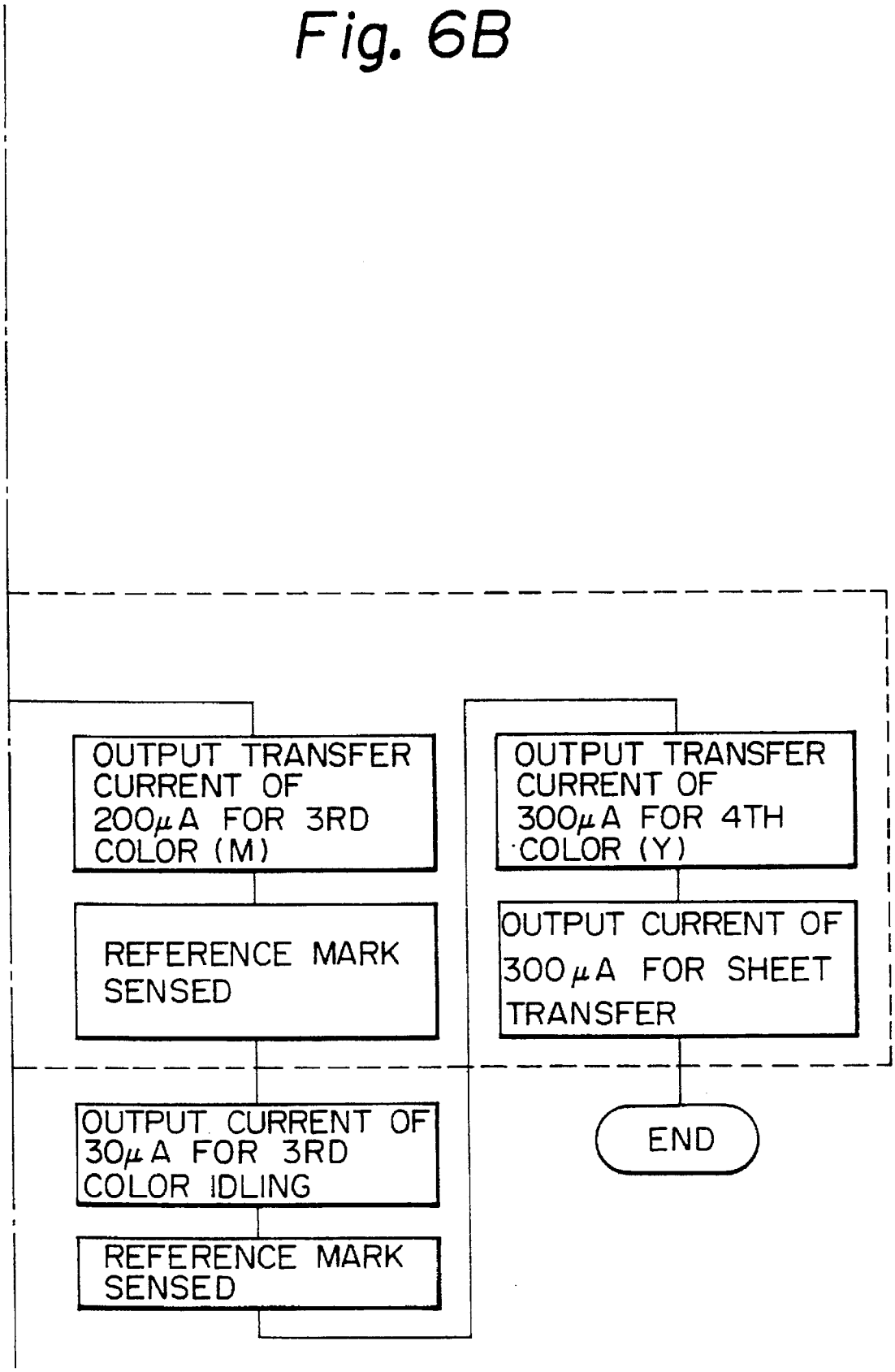

Another specific constant current control for image transfer is shown in FIG. 6. As shown, while a primary transfer current of 30 μm is also output during idling, the illustrative control procedure sequentially increases the primary transfer current stepwise every time a color is superposed on another color existing on the belt 426. Specifically, the belt transfer unit 450 outputs 50 μA for a black toner image, 100 μA for a cyan toner image, 200 μA for a magenta toner image, and 300 μA for a yellow toner image. The sheet transfer unit 454 outputs a secondary transfer current of 300 μA. Regarding A4 or similar small size, the primary transfer current and secondary transfer are controlled color by color in the same manner as shown in FIG. 5 although idling does not occur.

The low transfer current output during idling is a trade-off between the requisite that the amount of charge of toner (Q/M) on the belt 426 lies in the predetermined range shown in FIG. 2, and that the reverse transfer to the drum 402 due to the turn-off of the primary transfer current during idling be avoided. This will be described, taking the black toner image to be formed first as an example.

Figure 7:
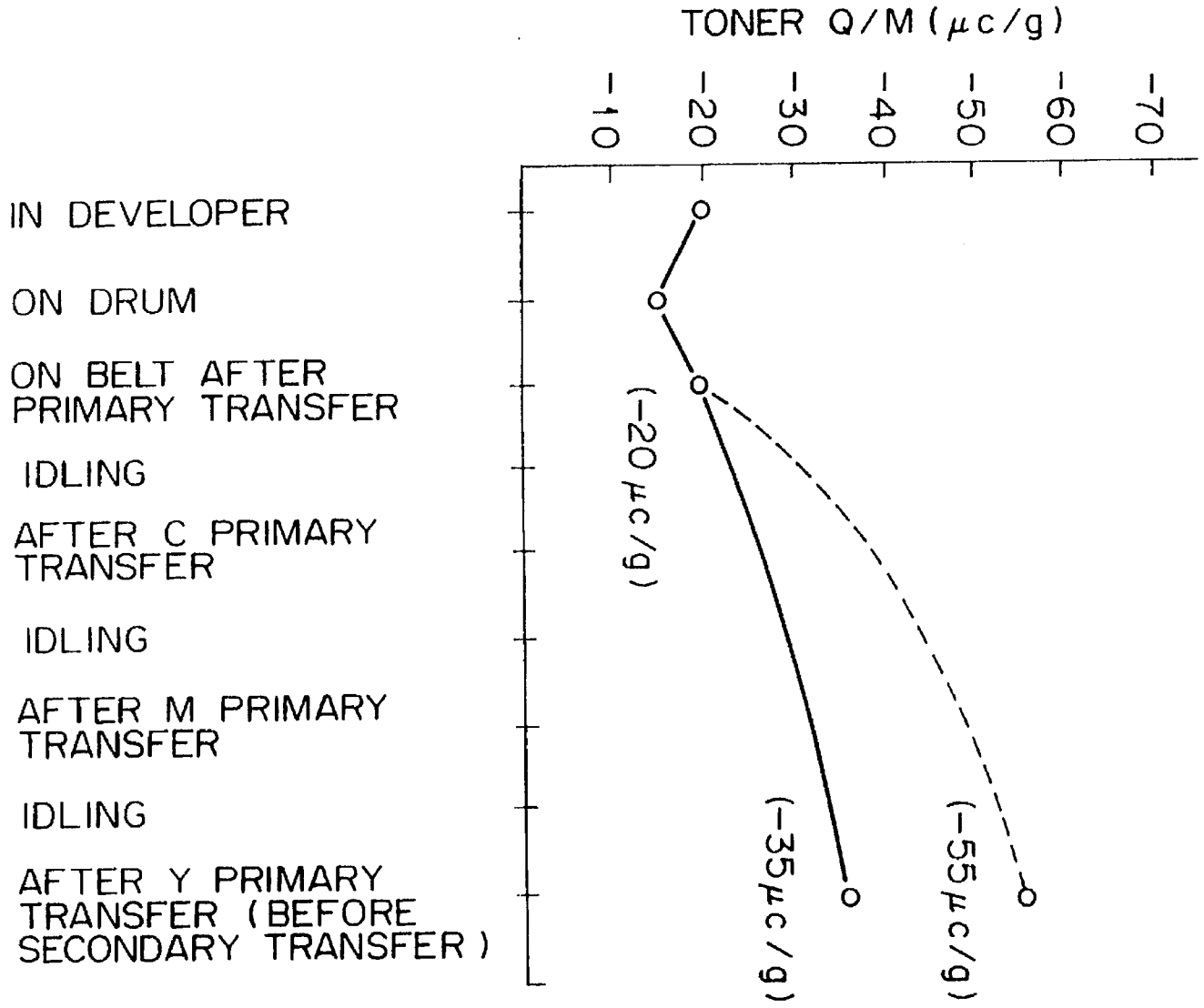
FIG. 7 is a graph showing how the amount of charge to deposit on toner changes during image formation.

As shown in FIG. 7, Q/M measured at normal temperature and humidity (23° C. and 65%)is about −20 μC/g in a developer whose toner concentration is 5 wt %. After development, Q/M decreases to about −15 μC/g since the toner having low Q/M is consumed first at the development stage. After the primary transfer, Q/M increases to about −20 μC/g. Subsequently, Q/M sequentially increases every time the belt 426 makes a turn. Before the secondary transfer, C/M is about −35 μC/g, which lies in the desirable range shown in FIG. 2, since the embodiment lowers the primary transfer current during idling. In contrast, with the conventional system which outputs the same primary transfer current during idling as during image formation, Q/M is about −55 μC/g (dotted curve in FIG. 7). These were found by a series of experiments. It will be seen from FIG. 7 that Q/M before the secondary transfer can be controlled on the basis of the output current during idling.

By confining the output current during idling in a range of from 10% to 50% of the primary current output during the immediately preceding image formation, it is possible to suppress the increase in Q/M before the secondary transfer of a large size which needs idling. That is, even a large size can be transferred as efficiently as a small size. In addition, when the output current during idling is smaller than the secondary transfer current, Q/M (particularly for the first color) is lowered to enhance the transfer to a sheet.

Figure 8:
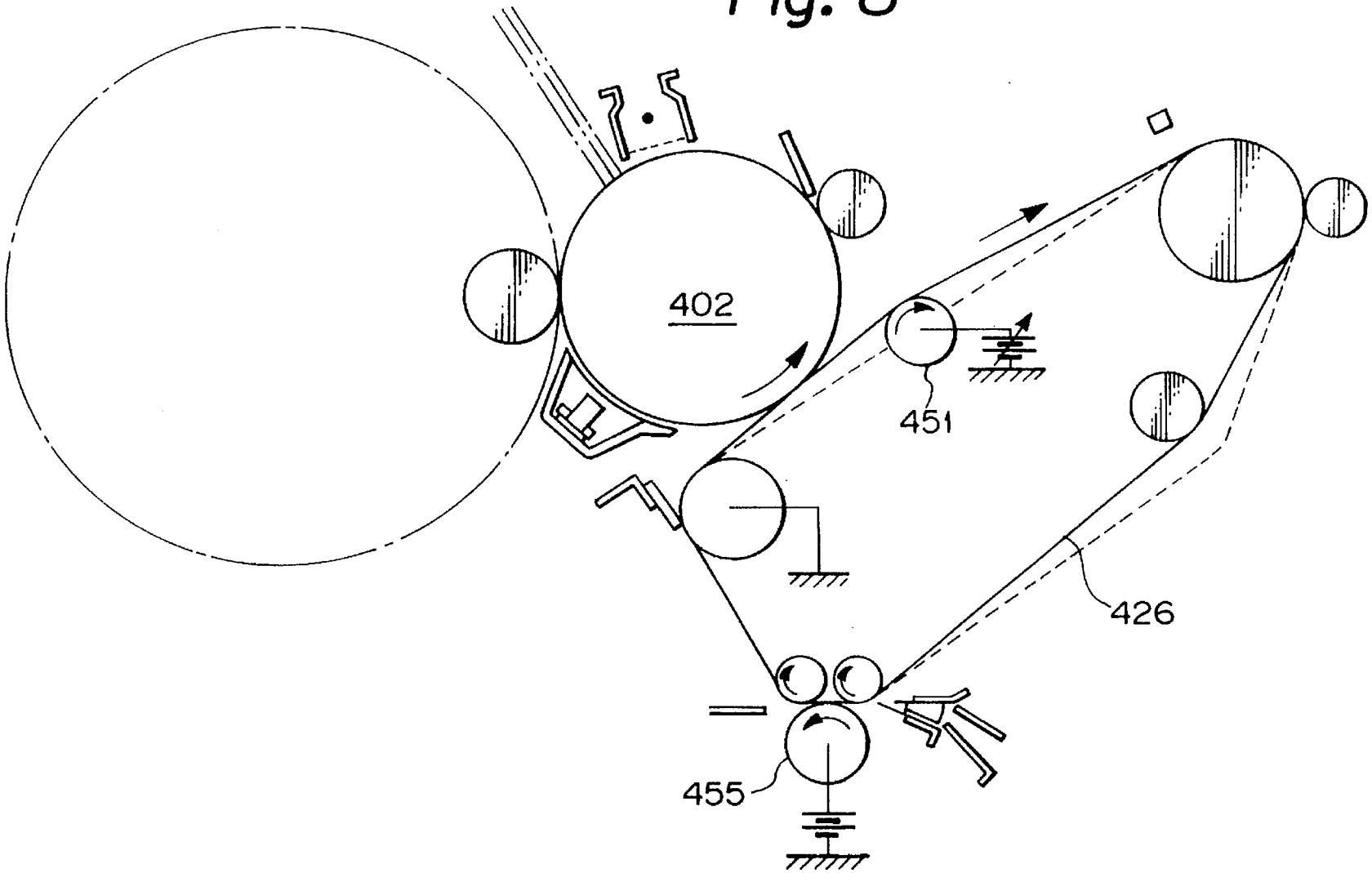
FIG. 8 shows image transfer using a transfer roller type image transfer unit.

FIG. 8 shows an alternative embodiment of the present invention. As shown, the belt transfer unit and sheet transfer unit are implemented as transfer rollers 451 and 455, respectively. The transfer roller, or primary transfer roller, 451 is held in contact with the rear of the belt 426 at a position downstream of the nip portion of the drum 402 and belt 426 in the direction of rotation of the belt 426. The transfer roller 451 is connected to a power source whose target control voltage is variable. This power source is controlled such that the output voltage thereof remains at a predetermined target voltage. The target voltage is variable such that the voltage increases stepwise during the transfer of the consecutive toner images from the drum 402 to the belt 426. The other transfer roller, or secondary transfer roller, 455 is located at a position where a toner image is transferred from the belt 426 to a sheet. The transfer roller 455 is connected to a power source which outputs a constant voltage.

At the beginning of an image forming operation, a positive transfer voltage is applied to the belt 426 via the primary transfer roller 451. As a result, there is generated on the belt 426 a potential gradient rising rightward, as viewed in FIG. 8, toward a roller which is located upstream of the nip position of the belt 426. A primary transfer electric field is formed by such a potential gradient and transfers a toner image of negative polarity from the drum 402 to the belt 426. After a four-color toner image has been completed on the belt 426, it is transferred to a sheet by a secondary transfer electric field, i.e., the secondary transfer roller 455 to which a positive voltage is applied. It is to be noted that the primary transfer roller 451 may contact the rear of the belt 426 at the nip portion of the drum 402 and belt 426.

Figure 9:
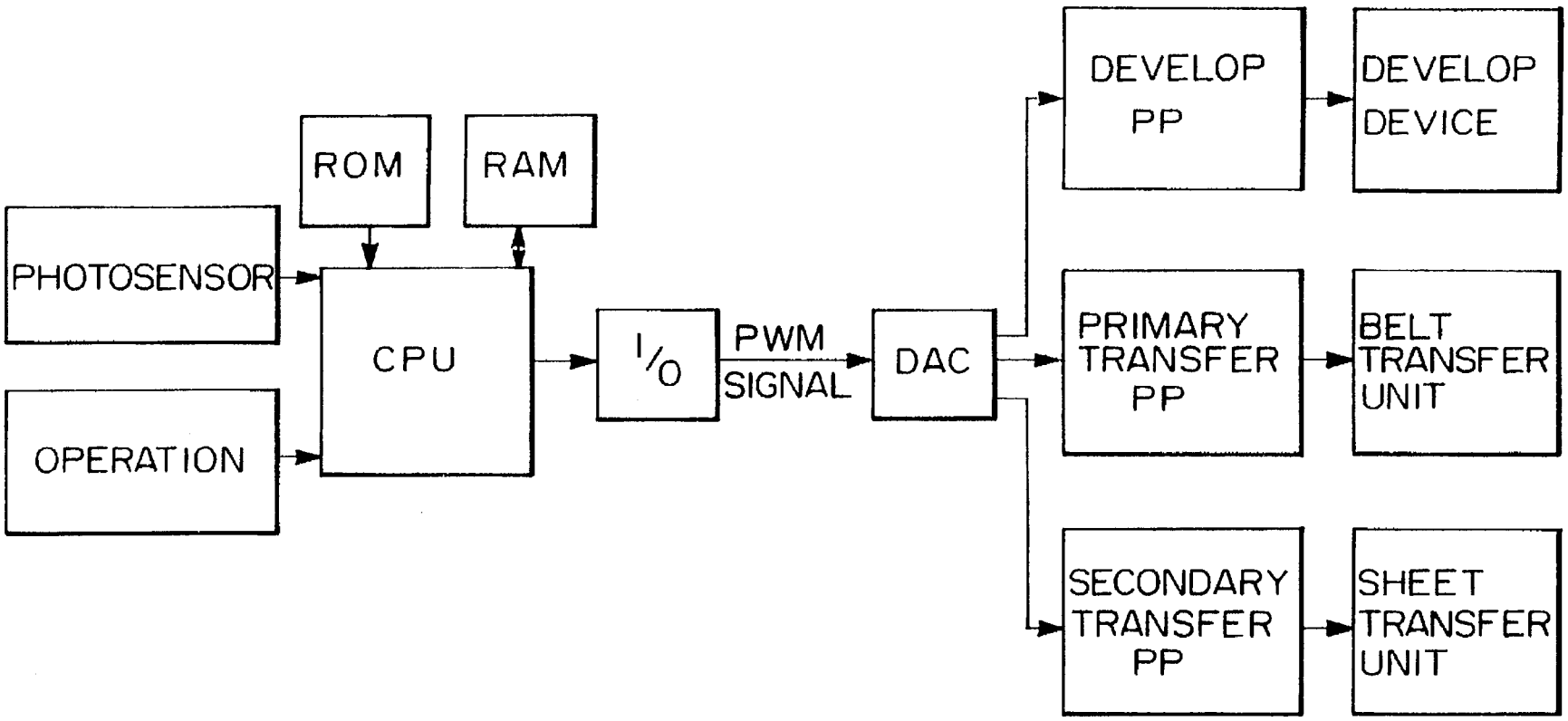
FIG. 9 is a block diagram schematically showing a control system in accordance with the present invention.

FIG. 9 shows a control system with which the above embodiments are practicable. As shown, when a full-color mode is selected on the operating section, a CPU (Central Processing Unit) determines whether or not the belt has completed one turn on the basis of the output of the photosensor responsive to the reference mark. A ROM (Read Only Memory) stores various kinds of data for image formation. When the belt completes one turn, the CPU causes, based on the data of the ROM, power packs (PPs; high tension power sources) for development, primary transfer and secondary transfer, as well as a power pack for charging although not shown, to apply high voltages to the developing device, belt transfer unit and sheet transfer unit via an I/O (Input/Output) board. In the case where constant current control is effected for the primary transfer output, the power pack is capable of changing the primary transfer output over a range of from 10 μA to 600 μA by pulse width modulation (PWM). In response to an eight-bit PWM signal, the duty of a reference voltage from a digital-to-analog converter (DAC) changes, changing the high tension current accordingly. Likewise, the secondary transfer output is variable in a range of from 10 μA to 800 μA.

Figure 10:
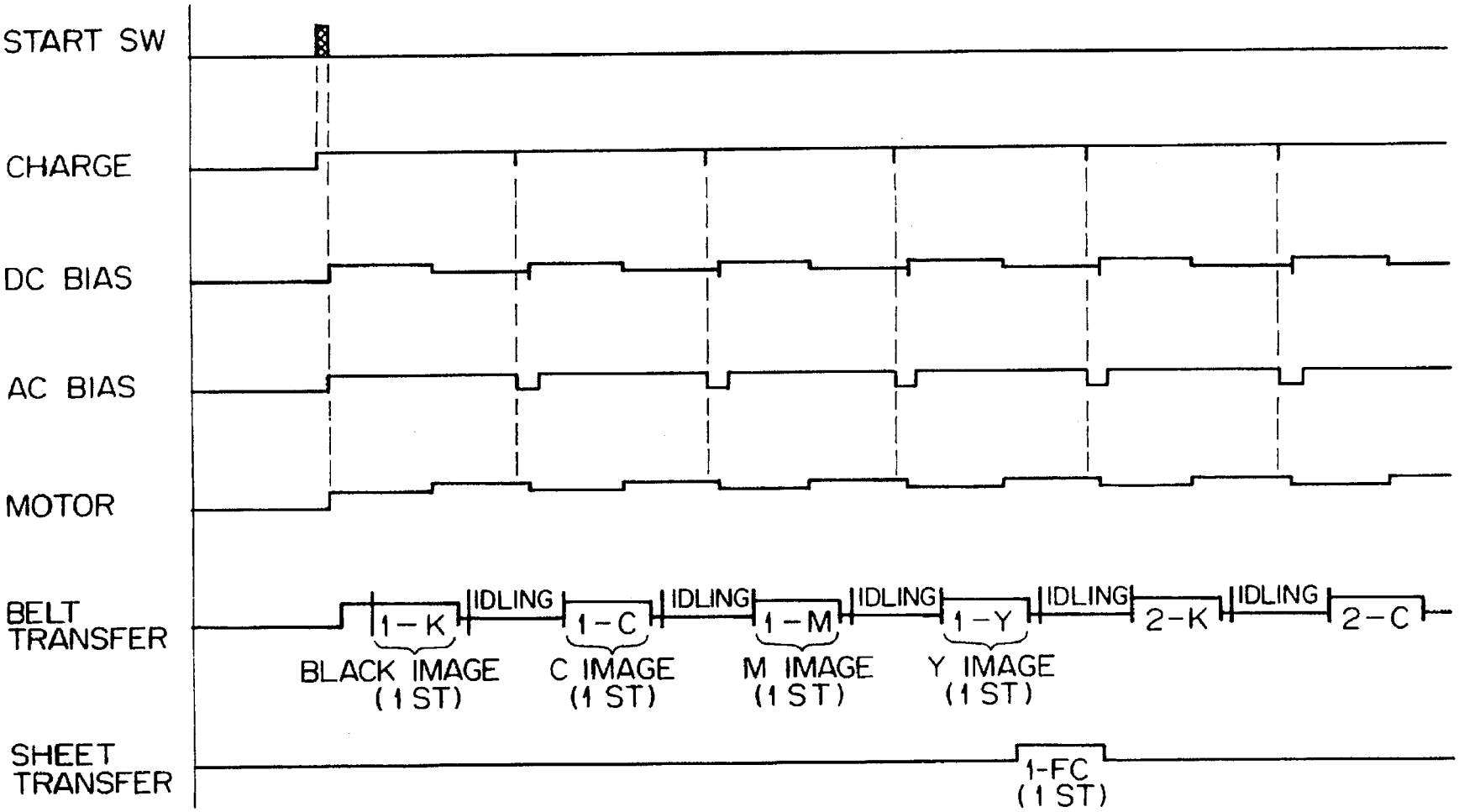
FIGS. 10, 11 and 12 are timing charts each demonstrating a specific operation in accordance with the present invention.

FIG. 10 is a timing chart demonstrating an example of the above-described full-color copying operation using the maximum size and in which the intermediate transfer belt selectively performs idling. When a start switch is pressed to start an image forming operation, the constituents shown in FIG. 10 each starts operating at a particular time. After black, cyan, magenta and yellow toner images have been sequentially transferred to the belt, the resulting composite image is transferred from the belt to a sheet at a time.

Figure 11:
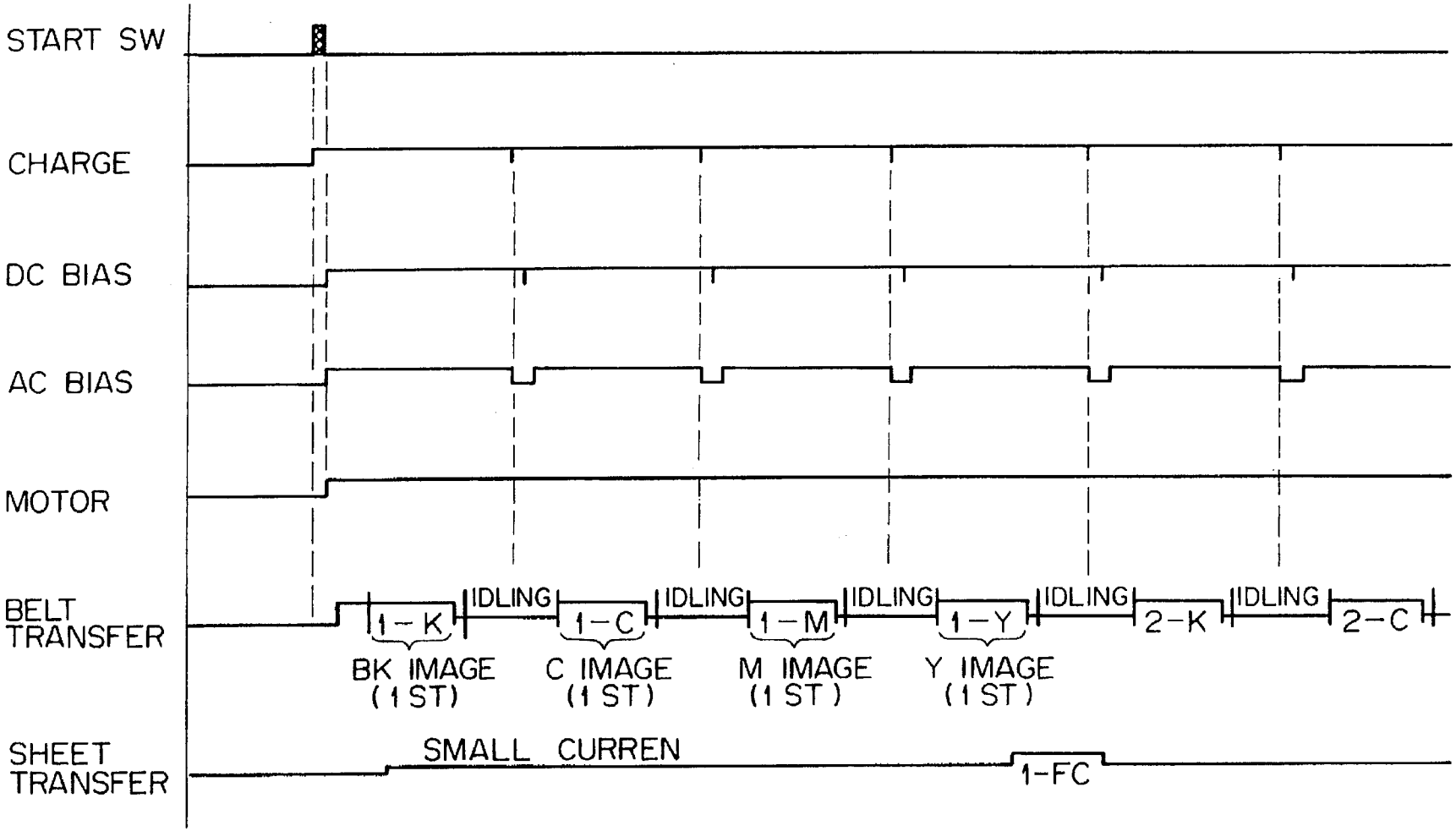

When the secondary image transferring means is implemented as a corona charger, an extremely small current may be applied to the charger while the belt is in rotation before the secondary transfer (six turns including idling). This will deposit a positive charge on the toner and thereby reduce the charge-up of negative polarity. Specifically, the small current may even be smaller than the primary current to be output during idling. Such an alternative scheme is shown in FIG. 11. In this case, it is preferable to slightly increase the primary current for idling, e.g., to about 50 μA.

Other possible implementations for changing the developing conditions in order to obviate reverse transfer during idling and background contamination are as follows.

It has been reported that reversal development, for example, causes a minimum of background contamination to occur if the difference between a charge potential VD and a bias voltage for development VB is great. For example, assuming a charge potential of −700 V, a DC bias and an AC bias for development shown in FIG. 10 may be superposed such that the bias potential for development is −550 V during image formation or −400 V during idling. In the case of regular or non-reversal development, the difference between a potential for exposure VL and the bias potential for development VB will be made greater during idling than during image formation.

To implement the non-developing state, the developer may be brought into an inoperative condition by any of conventional schemes. For example, a movable magnetic shield plate may be disposed between the surface of a development sleeve and a magnet accommodated in the sleeve. The shield plate will selectively prevent the developer from being deposited on the sleeve. Alternatively, the rotation of the sleeve relative to a photoconductive element may be reversed to render the developer inoperative due to a positional relation between a magnet and a stationary magnetic shield plate.

To increase the scavenging force, the ratio of the linear velocity of a developing roller to that of a photoconductive element may be made greater during idling than during image formation, as shown in FIG. 10. For example, when the above-mentioned ratio is 1.7 during image formation, it may be increased to 3.4 during idling. If desired, the ratio may be controlled such that the part of the photoconductive element which will face an intermediate transfer belt is brought into the non-developing condition, or such that the difference between the charge potential and the bias voltage for development increases.

Figure 12:
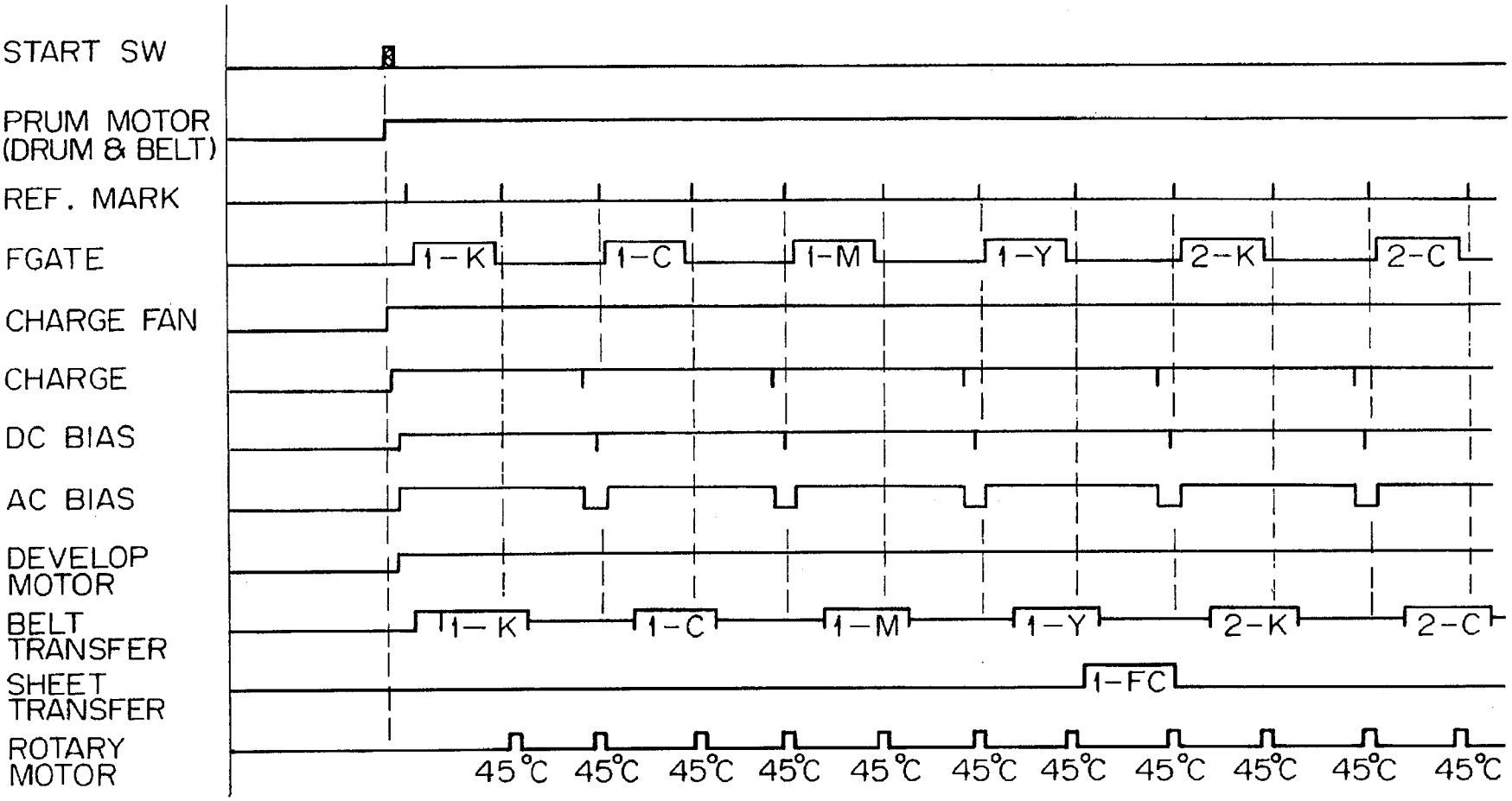

Further, when a revolver type developing device is used, as in the apparatus of FIG. 1, an arrangement may be made such that none of the development units of the revolver faces a photoconductive element. As a result, the part of the photoconductive element which will face an intermediate transfer belt is brought into the non-developing condition (see FIG. 12).

Moreover, a mechanism may be provided for moving an intermediate transfer belt into and out of contact with a photoconductive element. Basically, such a mechanism is conventional and includes a solenoid, half-rotation clutch, and cam. After the first or black toner image has been transferred from the photoconductive element to the belt, the belt starts idling. When a CPU, not shown, generates a belt release command, the mechanism moves the belt away from the photoconductive element by, for example, about 5 mm. After the image area has moved a distance corresponding to A3 size, but before the next toner image of different color arrives at a belt transfer position, the mechanism returns the belt to the position where it contacts the photoconductive element.

The photoconductive element, or image carrier, described above may, of course, be implemented as a belt in place of a drum. While the first and second image transferring means have been shown and described as being of the same kind, they may be implemented as a corona charger and a bias roller, respectively. Further, use may be made of a brush, blade or similar contact electrode, if desired. The two rollers facing the secondary transferring means at the secondary transfer position may be replaced with a single roller or even with a flat electrode. The transfer currents and voltages stated above and assigned to image formation and idling are only illustrative and may be adequately changed in matching relation to the environment, conditions of use, specifications of the apparatus body, etc.

In summary, it will be seen that the present invention provides an image forming apparatus having various unprecedented advantages, as enumerated below.

(1) An electric field output to be applied to primary image transferring means while an intermediate image transfer belt idles is controlled to a level lower than an electric field output during image formation and obstructing image transfer. Hence, a transfer electric field from an image carrier to the belt is reduced. This successfully obviates the transfer of toner contaminating the background of the image carrier to the belt and the reverse transfer of toner. Therefore, the present invention is particularly advantageous when the belt has a medium resistance and selectively idles.

(2) The electric field output to be applied to the primary image transferring means during idling is controlled such that toner on the belt has a predetermined amount of charge as measured at a secondary transfer position where the belt contacts a transfer material. This allows a composite toner image to be transferred from the belt to the transfer material in a desirable manner.

(3) The electric field output to be applied to the primary image transferring means during idling is controlled to be lower than an output applied thereto during image formation and, in addition, lower than an output applied to secondary image transferring means during secondary transfer. As a result, the transfer electric field from the image carrier to the belt is reduced. Again, this obviates the transfer of toner contaminating the background of the image carrier to the belt and the reverse transfer of toner. In addition, this allows a composite toner image to be transferred from the belt to the transfer material in a desirable manner.

(4) The electric field output to be applied to the primary image transferring means during idling depends on an output applied to the secondary image transferring means when the belt passes by without image transfer. This insures desirable primary transfer in relation to secondary transfer.

(5) The difference between the surface potential of the part of the image carrier that faces the image area of the belt and the bias potential for development is made greater during idling than during image formation. As a result, a minimum of background contamination is allowed to occur.

(6) During idling, the area of the part of the image carrier that faces the image area of the belt is held in a non-developing condition due to the inoperative condition of a developer. Further, such part of the image carrier is formed by making the ratio of the linear velocity of a developing roller to that of the above-mentioned part of the image carrier higher during idling than during image formation. In addition, during idling, none of developing units built in a revolver type developing device faces the image carrier. Therefore, the developing units themselves reduce background contamination and insure attractive images.

Various modifications will become possible for those skilled in the art after receiving the teachings of the present disclosure without departing from the scope thereof.

What is claimed is:

1. An image forming apparatus comprising:

an image carrier for sequentially forming toner images of respective colors thereon;

an intermediate image transferring member to which the toner images are sequentially transferred one above the other;

primary image transferring means for sequentially transferring the toner images from said image carrier to said intermediate image transferring member one above the other by charging, thereby forming a composite toner image;

secondary image transferring means for transferring the composite toner image from said intermediate image transferring member to a transfer material; and control means for controlling an electric field applied by said primary image transferring means to be lower than an electric field output by said primary image transfer means during a toner image transfer operation which transfers the toner image from said image carrier to said intermediate image transferring member, when an image area of said intermediate image transferring member to which at least one color has been transferred passes through, without image transfer, a primary transfer position where said intermediate image transferring member faces said image carrier.

2. An apparatus as claimed in claim 1, wherein when said image area of said intermediate image transferring member passes through said primary transfer position without image transfer, said control means controls said electric field output applied by said primary image transferring means to be 10% to 50% of said electric field output applied by said primary image transferring means during image formation.

3. An apparatus as claimed in claim 2, wherein said intermediate image transferring member has a volume resistivity ranging from $1\times10^{8}$ Ω.cm to $1\times10^{12}$ Ω.cm.

4. An image forming apparatus comprising:

an image carrier for sequentially forming toner images of respective colors thereon;

an intermediate image transferring member to which the toner images are sequentially transferred one above the other;

primary image transferring means for sequentially transferring the toner images from said image carrier to said intermediate image transferring member by charging, thereby forming a composition toner image;

secondary image transferring means for transferring the composite toner image from said intermediate image transferring member to a transfer material; and a control means for controlling an electric field output by said primary image transferring means, wherein the electric field output applied by said primary image transferring means when an image area of said intermediate image transferring member to which at least one color has been transferred passes through, without image transfer, a primary transfer position where said intermediate image transferring member faces said image carrier is controlled by said control means such that toner carried on said intermediate image transferring member has a predetermined amount of charge, as measured at a secondary transfer position where said intermediate image transferring member faces the transfer material, and wherein said electric field output applied by said primary image transferring means when said image area of said intermediate image transfer member passes through said primary transfer position without image transfer is controlled by said control means to be lower than an electric field output preselected for image formation and controlled such that the toner carried on said intermediate image transferring member has a predetermined amount of charge, as measured at said secondary transfer position.

5. An apparatus as claimed in claim 4, wherein said predetermined amount of charge is 10 μC/g to 40 μC/g at normal temperature and normal humidity.

6. An apparatus as claimed in claim 5, wherein said intermediate image transferring member has a volume resistivity ranging from $1\times10^{8}$ Ω.cm to $1\times10^{12}$ Ω.cm.

7. An apparatus as claimed in claim 4, wherein said electric field output applied to said primary image transferring means when said image area of said intermediate image transferring member passes through said primary transfer position without image transfer is controlled by said control means to be 10% to 50% of an electric field output preselected for image formation.

8. An apparatus as claimed in claim 7, wherein said intermediate image transferring member has a volume resistivity ranging from $1\times10^{8}$ Ωcm to $1\times10^{12}$ Ω.cm.

9. An apparatus as claimed in claim 4 wherein the toner on said intermediate image transferring member is toner formed for a first image.

10. An image forming apparatus comprising:

an image carrier for sequentially forming toner images of respective colors thereon;

an intermediate image transferring member to which the toner images are sequentially transferred one above the other;

primary image transferring means for sequentially transferring the toner images from said image carrier to said intermediate image transferring member by charging, thereby forming a composite toner image;

secondary image transferring means for transferring the composite toner image from said intermediate image transferring member to a transfer material; and a control means for controlling an electric field output by said primary image transferring means, wherein the electric field output applied to said primary image transferring means when an image area of said intermediate image transferring member to which at least one color has been transferred passes through, without image transfer, a primary transfer position where said intermediate image transferring member faces said image carrier is controlled by the control means to be lower than an electric field output preselected for image formation and lower than an electric field output applied to said second image transferring means in the event of secondary image transfer to the transfer material.

11. An image forming apparatus comprising:

an image carrier for sequentially forming toner images of respective colors thereon;

an intermediate image transferring member to which the toner images are sequentially transferred one above the other;

primary image transferring means for sequentially transferring the toner images from said image carrier to said intermediate image transferring member by charging, thereby forming a composite toner image;

secondary image transferring means for transferring the composite toner image from said intermediate image transferring member to a transfer material; and a control means for controlling an electric field output by said primary image transferring means, wherein the electric field output applied by said primary image transferring means when an image area of said intermediate image transferring member to which at least one color has been transferred passes through, without image transfer, a primary transfer position where said intermediate image transferring member faces said image carrier is controlled by said control means to be dependent on an electric field output applied to said secondary image transferring means when said image area passes through, without image transfer, a secondary transfer position where said intermediate image transferring member faces the transfer material.

12. An apparatus as claimed in claim 11, wherein said electric field output applied by said primary image transferring means when said image area of said intermediate image transfer member passes through said primary transfer position without image transfer is controlled by the control means to be higher than said electric field output applied to said secondary image transferring means.

13. An image forming apparatus comprising:

an image carrier on which toner images of respective colors are sequentially formed by developing means which is applied with a bias for development;

an intermediate image transferring member to which the toner images are sequentially transferred one above the other;

primary image transferring means for sequentially transferring the toner images from said image carrier to said intermediate image transferring member by charging, thereby forming a composite toner image;

secondary image transferring means for transferring the composite toner image from said intermediate image transferring member to a transfer material; and a control means for controlling an electric field output by said primary image transferring means, wherein when an image area of said intermediate image transferring member to which at least one color has been transferred passes through, without image transfer, a primary transfer position where said intermediate image transferring member faces said image carrier, a difference between a surface potential of an area of said image carrier facing said image area and said bias for development is controlled by the control means to be greater than a difference preselected for image formation.

14. An image forming apparatus comprising:

an image carrier on which toner images of respective colors are sequentially formed by toner of said respective colors which are fed from respective developing rollers;

an intermediate image transferring member to which the toner images are sequentially transferred one above the other;

primary image transferring means for sequentially transferring the toner images from said image carrier to said intermediate image transferring member by charging, thereby forming a composite toner image;

secondary image transferring means for transferring the composite toner image from said intermediate image transferring member to a transfer material; and a control means for controlling a linear velocity of said image carrier and developing rollers, wherein when an area of said image carrier to face an image area of said intermediate image transferring carrier, to which at least one color has been transferred, when said image area passes through, without image transfer, a primary transfer position where said intermediate image transferring member faces said image carrier is formed by controlling by said control means a ratio of the linear velocity of any one of said developing rollers to the linear velocity of said image carrier higher than a ratio preselected for image formation.

15. An image forming apparatus comprising:

an image carrier on which toner images of respective colors are sequentially formed by toner of said respective colors each being stored in one of developing units of a revolver type developing device;

an intermediate image transferring member to which the toner images are sequentially transferred one above the other;

primary image transferring means for sequentially transferring the toner images from said image carrier to said intermediate image transferring member by charging, thereby forming a composite toner image;

secondary image transferring means for transferring the composite toner image from said intermediate image transferring member to a transfer material;

control means for controlling a revolving of said developing device, wherein when an image area of said intermediate image transferring member to which at least one color has been transferred passes through, without image transfer, a primary transfer position where said intermediate image transferring member faces said image carrier, said control means controls said developing device such that none of said developing units faces said image carrier.

* * * * *